United States Patent [19]

Shaw et al.

[11] 4,142,727

[45] Mar. 6, 1979

[54] GOLF BALLS

[75] Inventors: Michael Shaw, Widnes; Robert C. Haines, Huddersfield, both of England

[73] Assignee: Dunlop Limited, London, England

[21] Appl. No.: 716,348

[22] Filed: Aug. 20, 1976

[30] Foreign Application Priority Data

Sep. 6, 1975 [GB] United Kingdom ..... 36794/75

[51] Int. Cl.[2] ..... A63B 37/14

[52] U.S. Cl. ..... 273/232; 40/327

[58] Field of Search ..... 273/232, 235 R, 235 A, 273/235 B; 40/327

[56] References Cited

U.S. PATENT DOCUMENTS

| | | | |
|---|---|---|---|
| 878,254 | 2/1908 | Taylor | 273/232 |
| 2,728,576 | 12/1955 | Martin | 273/232 |

FOREIGN PATENT DOCUMENTS

| | | | |
|---|---|---|---|
| 2338302 | 2/1974 | Fed. Rep. of Germany | 273/232 |
| 377354 | 7/1932 | United Kingdom | 273/232 |

OTHER PUBLICATIONS

"The Curious History of the Golf Ball, Mankind's Most Fascinating Sphere," by John Stuart Martin, Horizon Press, N. Y., 1968.

*Primary Examiner*—George J. Marlo

*Attorney, Agent, or Firm*—Stevens, Davis, Miller & Mosher

[57] ABSTRACT

A golf ball has a surface pattern of dimples arranged to provide at least 12 symmetrically disposed bald patches, a bald patch being defined in terms of its ability to accommodate a spherical rectangle of specified minimum width and area relative to the dimple size.

6 Claims, 3 Drawing Figures

GOLF BALLS

The present invention relates to golf balls, and is particularly concerned with the surface configuration of golf balls.

Golf balls have, for many years, been provided with dimples — i.e. depressions or indentations — in their surface since it is found that this gives superior aerodynamic properties compared with a smooth ball. Many efforts have been made to vary the size and depth of the dimples and the disposition of the dimples on the surface ("dimple pattern") to obtain optimum aerodynamic properties and hence flight performance.

Hitherto, it has been thought that the dimples should be closely packed and arranged as uniformly as possible over the surface of the ball.

We have now discovered, however, that it can be advantageous to provide certain dimple-free areas on the surface of the ball.

Thus, according to the present invention there is provided a golf ball in the shape of a sphere having in its surface a plurality of dimples or depressions and which has at least twelve bald patches symmetrically disposed on the surface of the ball.

A "bald patch" is defined as any region on the surface of the ball on which it is possible to draw a spherical rectangle having a width of at least half of the mean dimple diameter and a surface area of at least twice the mean dimple area, the rectangle not enclosing any dimple or part thereof. By a spherical rectangle we mean a radial projection of a rectangle on to the surface of a sphere, the sides of the rectangle thus being arcs of great circles of the sphere. By "length" and "width" we mean the larger and smaller arc lengths respectively, although it is not intended to exclude the case where they are equal — i.e. a square, and by "surface area" we mean the area of that part of the surface of the sphere bounded by the rectangle. By "mean dimple diameter" is meant the average of the diameters of all the dimples on the ball, while by "mean dimple area" is meant the area of a dimple having the mean diameter — i.e. (mean dimple diameter)$^2 \times \pi/4$.

Preferably the width of the rectangle is at least three-quarters of the mean dimple diameter, while the area of the rectangle is at least four times the mean dimple area.

It is preferred that the bald patch size shall not exceed a maximum defined by the following conditions:

(i) it should not be possible to draw on the bald patch a square having sides whose length is greater than twice the mean dimple diameter; or (ii) it should not be possible to draw on the bald patch a rectangle having a width of at least half the mean dimple diameter and an area of more than eight times the mean dimple area.

In a preferred embodiment the configuration of the dimples or depressions is substantially the same in each of those twelve regions of the surface of the sphere which are defined by lines formed by projecting on to the surface the edges of a regular dodecahedron whose vertices lie in the surface of the sphere.

In the case of a dodecahedron there will be 12 substantially identical pentagonal regions. Thus the preferred number of bald patches to maintain symmetry for such a system is 20, 12 or 30 according to whether the patches are located at the vertices, at the centers of the faces or the mid-points of the edges.

However, the invention is not limited to use in a dodecahedron system of dimple arrangement but can be utilized in other systems, e.g. any of the more conventional dimple arrangements that have been proposed. These include spatial arrangements derived by projecting into the surface of the sphere the edges of an icosahedron or octahedron.

For an icosahedron, having 20 triangular regions the preferred numbers will be 12, 20 or 30 for patches at the vertices, centers of the faces or mid-points of the edges respectively.

For an octahedral arrangement the preferred number will be 12 (8 or 6 are of course theoretically possible from geometrical considerations, but fall below the minimum number required in practice).

There may be dimples provided on the boundary lines of the regions, or the lines may be free from dimples, but preferably the dimples arrangement is symmetrical about any boundary line.

The dimples may all be of the same size and shape, but it may be convenient to provide some dimples of differing size and/or shape. The dimples may, if desired, have rounded edges.

The dimples are preferably of circular appearance in plan view, their shape being that of a solid of revolution generated by the rotation of a plane curve about a radius of the ball, such as a segment of a sphere or of an ellipsoid, but other shapes may be used, e.g. dimples may be provided whose appearance in plan view is oval or polygonal.

The dimple diameters may vary according to the size of the ball but are, for dimples circular in plan preferably in the range 0.085 inches to 0.150 inches, especially 0.090 inches to 0.145 inches. Preferably the largest dimples have diameters in the range 0.110 inches to 0.150 inches.

The ratio of the maximum depth of the dimples to the diameter may be between 1:6 and 1:15, e.g. 1:10. Thus it is preferred that the dimple depths are in the range 0.009 inches to 0.014 inches.

By "dimple depths" or "maximum dimple depths" in this specification is meant the measurement along a radius of the golf ball which passes through the lowest point of the dimple, the measurement being from that lowest point where the radius crosses the projection above the dimple of the great circle of the surface of the ball.

While any desired number of dimples may be provided, it is preferred that there should be at least 240 dimples, preferably not more than 480, for example, the ball may be provided with 360 dimples.

The optimum number of dimples will, of course, vary according to the dimple size(s) used. Most dimple arrangements result in a total dimple area of about 50–60% of the ball surface — e.g. 240 × 0.150 inch dimples on a 1.62 inch ball gives approximately 51% coverage, while 480 × 0.110 inch dimples gives a figure of about 55%. These figures are not quoted by way of limitation but merely as a guide.

Golf ball covers are conventionally moulded in a two-part mould, which results in a seam line being visible at the joint between the two mould halves. In practice the mould halves are hemispherical and this seam line is therefore a great circle of the sphere — indeed, to construct a mould so as to provide a seam line of any other configuration presents severe practical problems. The seam line should preferably not pass through any dimples on the ball surface. Thus it will be appreciated that, in practice, it will generally be necessary to arrange the dimple configuration to allow for this.

The dimple configuration of the present invention may be applied to the surface of any conventional golf ball whether of 1.62 inch, 1.68 inch diameter or any intermediate or other size. The construction of the golf ball also may be any conventionally used. For example, the ball may have a unit-construction, i.e. be in a single piece moulded from a suitable rubber or plastic composition. It may be a two-piece ball having a unit-construction core encased in a cover or it may have a multi-construction core encased in a protective cover, and the present invention is eminently suitable for use with such balls.

Where the ball is of the type having a separately-applied cover around a core, the cover may be moulded from any conventionally used material, e.g. balata; gutta percha; synthetic trans-polyisoprene; polyurethane; polyethylene, the cover materials of the assignee's British Pat. No. 1 087 566 or any desired blends thereof. The cover may be formed by any conventional means. For example, it may be moulded as two separate hemispherical half-shells which are then compression moulded around the core. Alternatively it may be injection moulded around the core in a single operation.

The dimple configuration will normally be applied to the ball during the moulding of the cover around the core (or during the moulding of the unitary sphere in the case of a single-piece ball) by use of appropriately-shaped negative moulds containing the dimple pattern in reverse, this being quite conventional in the field of golf ball manufacture. Accordingly in another aspect the invention provides a golf ball mould whose moulding surface contains a pattern to give the golf ball dimple configuration of twelve symmetrically disposed bald patches.

The moulded golf ball having the desired dimple configuration may then be painted in the conventional manner.

Alternatively, painting may be rendered unnecessary by suitable compounding of the composition used, this being a well-known practice particularly for the above-mentioned one piece golf balls.

The invention will now be further described, by way of example only, with reference to the accompanying drawings, in which.

Figure 1:
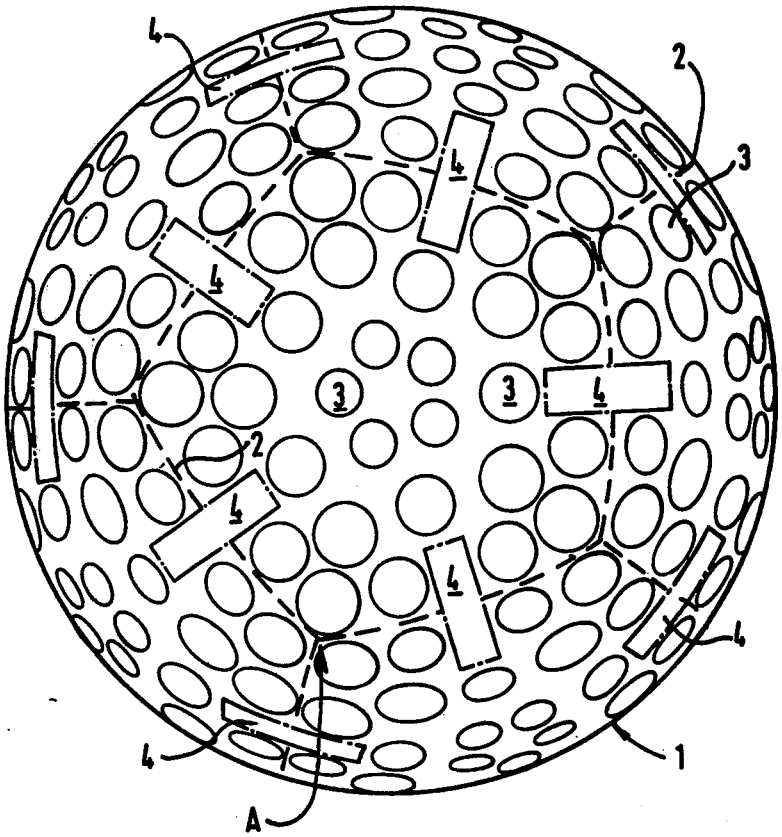
FIG. 1 is a perspective view of a golf ball according to the present invention.

A golf ball 1 (FIGS. 1 and 2) is provided with dimples 3, the arrangement of the dimples in each of twelve surface regions defined by twelve contiguous regular spherical pentagons (indicated in the drawing by dotted lines 2) being identical. Each dimple is a depression in the shape of a segment of a sphere.

(A spherical pentagon is defined as the figure on the surface of the sphere which is bounded by five great circles inscribed on the surface of the sphere. A regular spherical pentagon is a spherical pentagon whose internal angles are equal and whose sides are equal in length).

The arrangement of the dimples is such that the ball is provided with bald areas 4, indicated in the drawings by chain-dot rectangles, on the mid-points of the sides of the spherical pentagons, so that there is a total of thirty such areas symmetrically disposed around the ball.

Figure 3:
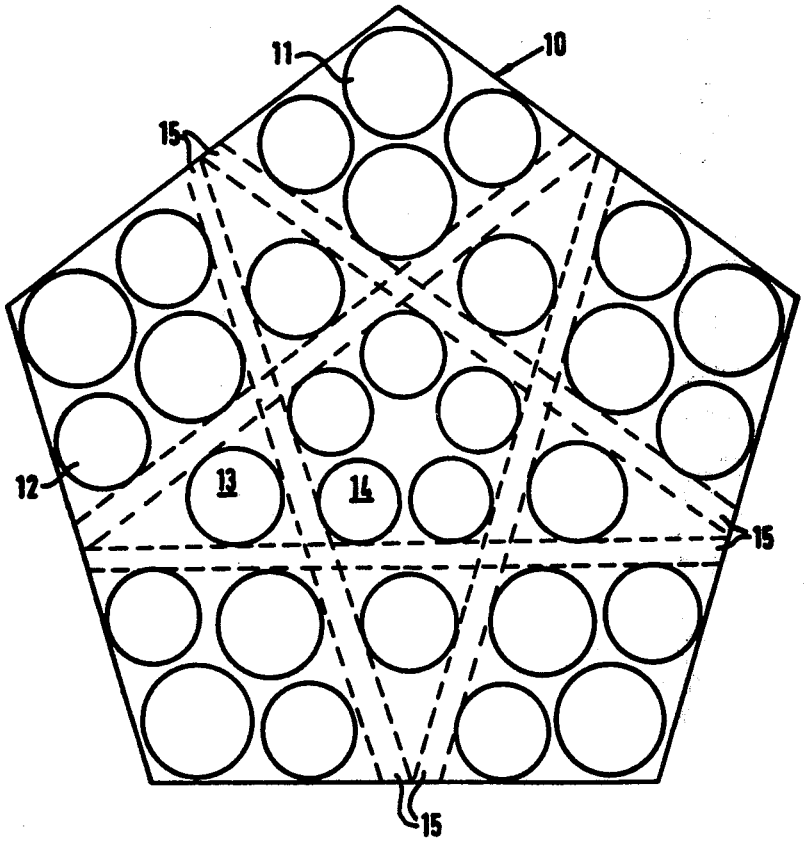
FIG. 3 shows a two-dimensional arrangement of a particular dimple pattern within a pentagonal area.

The arrangement of dimples in each pentagon is a projection of the planar arrangement shown in detail in FIG. 3. The pentagonal outline 10 encloses dimples 11, 12, 13, 14 of different sizes. The dotted lines 15 show possible positions for the seam line of the ball: there are ten such great circles on the surface of the ball — i.e. ten planes of symmetry.

It will be appreciated that the dimple pattern shown on the drawings is but one example of many different possible arrangements.

The invention will now be illustrated by means of the following examples.

EXAMPLES

Figure 2:
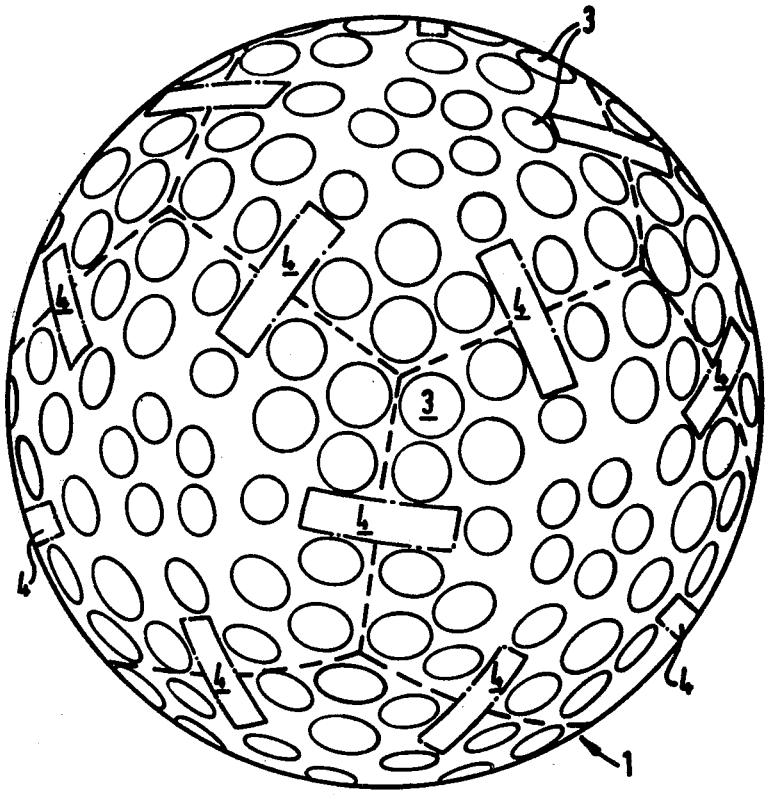
FIG. 2 is a perspective view of the golf ball of FIG. 1 taken from a different viewpoint. (Along arrow A of FIG. 1.)

Golf balls according to the invention were manufactured having the dimple pattern shown in FIGS. 1, 2 and 3. The dimple depth was 0.011 inches, while the dimple numbers and diameters were as follows (dimple reference numbers refer to FIG. 3):

| Dimple | Diameter(inches) | No. on Ball |
|---|---|---|
| 11 | 0.135 | 120 |
| 12 | 0.125 | 120 |
| 13 | 0.120 | 60 |
| 14 | 0.110 | 60 |

The total number of dimples was thus 360, the mean dimple diameter was 0.125 inches and the mean dimple area (as hereinbefore defined) was 0.01228 square inches. There were thirty bald patches, as shown in the drawings. The largest rectangle which could be fitted into the bald patch — i.e. with sides tangential to the six adjacent dimples, measured 0.107 inches × 0.46 inches — i.e. a width of 0.856 dimple diameters and an area of 4.01 times the mean dimple area.

Comparative flight tests were carried out to evaluate the performance of these balls in terms of distance of travel through the air (carry) when the balls were tested on a flight test machine. The standards for comparison were balls made with a dimple pattern based on the octahedron. Such a pattern has long been established as 'conventional' and the majority of golf balls currently manufactured in the world are made incorporating such a pattern although variations occur from one manufacturer to another with regard to the total number of dimples, dimple depths and dimple diameters.

For the purposes of the comparative test referred to here the standard balls had a conventional pattern composed of 336 dimples of which all but 32 dimples were of diameter 0.130 inches (the 32 being of diameter 0.110 inches). In the case of one standard ball the depth of each dimple was 0.011 inches and in the case of the other the depth of each dimple was 0.013 inches. The 0.013 inches depth is the one most commonly used for golf balls currently made in the world with the conventional pattern.

All balls were of 1.62 inches diameter and were made using liquid centers wound with a highly stretched thread based on a blend of natural rubber and cis-polyisoprene. The covers were moulded from a 90/10 blend of an ionomer and EVA (see British Patent Nos. 1 087 566 and 1 383 422). Normal manufacturing procedure was used in each case.

The compression of the balls was measured — i.e. the deformation of the ball (in thousandths of an inch) under a load of 100 lbs weight. The balls were then subjected to flight tests. This is carried out using a flight machine specifically designed for comparative testing of golf balls. Basically this machine simulates the driving action of a No. 1 Wood club and enables a consistent and accurately reproducible impact to be given to a succession of golf balls. The speed of the club head as it impacts the stationary ball can be varied by means of weights: the speed used in the tests was 158.5 ft/sec.

The Carry was measured visually by noting where the balls landed relative to a number of prepositioned markers placed down the flight patch.

The results of the tests are shown in Table I. It should be noted that external factors — i.e. wind, etc., will vary from one series of tests to another so that, for example, the results of test I are not directly comparable with those of test II.

TABLE I

| | FLIGHT TEST RESULTS | | |
|---|---|---|---|
| TEST I | Weight | Compression | Carry |
| Golf ball of the invention, example I | 45.4 gms | 59 | 232 yds |
| Standard Ball 0.011" Dimple Depth | 45.3 gms | 58 | 230 yds |
| (Mean of 4 flights on 4 balls of each type) | | | |
| Test II | | | |
| Golf ball of the invention, example 2 | 45.2 gms | 54 | 237 yds |
| Standard Ball 0.013" Dimple Depth | 45.5 | 55 | 235 yds |
| (Mean of 3 flights on 12 balls of each type) | | | |

It can be seen from the above results that an improvement in carry of 2 yards was obtained by means of the invention.

Having now described our invention what we claim is:

1. A golf ball in the shape of a sphere having in its surface from 240 to 480 dimples of circular plan form, the dimples having diameters in the range of 0.085 to 0.150 inches and 30 bald patches symmetrically distributed over the surface of the sphere, the configuration of the dimples being substantially the same in each of those twelve regions of the surface of the sphere which are defined by lines formed by projecting onto the surface the edges of a regular dodecahedron whose vertices lie in the surface of the sphere and the configuration being such that said 30 bald patches are symmetrically disposed over the surface of the ball, a bald patch being located at the mid-point of each edge of the dodecahedron, a bald patch being any region on the surface of the ball of such a size that it is possible to draw on it a spherical rectangle having a width of at least half of the mean dimple diameter and a surface area of at least twice the mean dimple area but not exceeding a maximum defined by the conditions that it is not possible to draw on the bald patch:

(i) a square having sides whose length is greater than twice the mean dimple diameter; or (ii) a rectangle having a width of at least half the mean dimple diameter and an area of more than eight times the mean dimple area, said rectangle and square for determining the minimum and maximum sizes not enclosing any dimple or part thereof.

2. A golf ball according to claim 1, in which the minimum width of the rectangle that can be drawn on the bald patch is three quarters of the mean dimple diameter while the minimum area of the rectangle is four times the mean dimple area.

3. A golf ball according to claim 1, in which the dimples have diameters in the range 0.090 inches to 0.145 inches.

4. A golf ball according to claim 1, in which the ratio of the maximum depth of the dimples to their diameter is between 1:6 and 1:15.

5. A golf ball according to claim 1, in which the total dimple area is from 50 to 60% of the ball surface.

6. A golf ball according to claim 1, which has 360 dimples, said dimples being of the following numbers and diameters:

120 of 0.135 inch
120 of 0.125 inch
60 of 0.120 inch
60 of 0.110 inch and being uniformly distributed in the said twelve regions of the surface of the sphere.

* * * * *